US010885744B2

(12) United States Patent
Vann

(10) Patent No.: US 10,885,744 B2
(45) Date of Patent: Jan. 5, 2021

(54) GAMING SYSTEM WITH SKILL-BASED PROGRESSIVE JACKPOT FEATURE

(71) Applicant: BALLY GAMING, INC., Las Vegas, NV (US)

(72) Inventor: Jamie W Vann, Chicago, IL (US)

(73) Assignee: SG Gaming, Inc., Las Vegas, NV (US)

( * ) Notice: Subject to any disclaimer, the term of this patent is extended or adjusted under 35 U.S.C. 154(b) by 538 days.

(21) Appl. No.: 14/865,248

(22) Filed: Sep. 25, 2015

(65) Prior Publication Data

US 2017/0092068 A1 Mar. 30, 2017

(51) Int. Cl.
*G07F 17/32* (2006.01)

(52) U.S. Cl.
CPC ..... *G07F 17/3262* (2013.01); *G07F 17/3258* (2013.01); *G07F 17/3295* (2013.01)

(58) Field of Classification Search
CPC ... G07F 17/32; G07F 17/3267; G07F 17/3295
USPC ..... 463/16–20
See application file for complete search history.

(56) References Cited

U.S. PATENT DOCUMENTS 6,186,894 B1 * 2/2001 Mayeroff ..... G07F 17/32 273/138.1
6,572,473 B1 6/2003 Baerlocher
6,626,758 B1 9/2003 Parham et al.
6,698,759 B2 3/2004 Webb et al.
6,761,632 B2 7/2004 Bansemer et al.
6,780,103 B2 8/2004 Bansemer et al.
6,918,830 B2 7/2005 Baerlocher
6,942,568 B2 9/2005 Baerlocher
7,056,210 B2 6/2006 Bansemer et al.
(Continued)

FOREIGN PATENT DOCUMENTS

AU WO2015168749 A1 11/2015

OTHER PUBLICATIONS

U.S. Appl. No. 15/233,114 Non-Final Office Action, dated Sep. 24, 2018, 8 pages.

(Continued)

*Primary Examiner* — Omkar A Deodhar
*Assistant Examiner* — Ross A Williams

(57) ABSTRACT

A gaming system comprising a regulated gaming machine primarily dedicated to playing at least one casino wagering game. The gaming machine includes an electronic display device and one or more electronic input devices and game-logic circuitry configured to detect, via at least one of the one or more electronic input devices, a physical item associated with a monetary value that establishes a credit balance. The game-logic circuitry is further configured to initiate the casino wagering game in response to an input indicative of a wager covered by the credit balance. The game-logic circuitry is further configured to increment a progressive jackpot associated with the wagering game. The game-logic circuitry is further configured to conduct a skill-based bonus game that awards portions of the incremented progressive jackpot based on skillful inputs of a player in response to a triggering event occurring during the wagering game. The game-logic circuitry is further configured to receive, via at least one of the one or more electronic input devices, a cashout input that initiates a payout from the credit balance.

15 Claims, 10 Drawing Sheets

(56) References Cited

U.S. PATENT DOCUMENTS

| | | | | |
|---|---|---|---|---|
| 7,175,524 | B2 | 2/2007 | Bansemer et al. | |
| 7,297,059 | B2 | 11/2007 | Vancura et al. | |
| 7,357,716 | B2 | 4/2008 | Marks et al. | |
| 7,473,175 | B2 | 1/2009 | Baerlocher | |
| 7,575,517 | B2 | 8/2009 | Parham et al. | |
| 7,722,461 | B2 | 5/2010 | Gatto et al. | |
| 7,789,749 | B2 | 9/2010 | Bansemer et al. | |
| 7,811,168 | B2 | 10/2010 | Parham et al. | |
| 7,846,015 | B2 | 12/2010 | Bansemer et al. | |
| 7,887,415 | B2 | 2/2011 | Parham et al. | |
| 7,963,845 | B2 | 6/2011 | Baerlocher | |
| 8,033,912 | B2 | 10/2011 | Cannon | |
| 8,075,391 | B2 | 12/2011 | Rommerdahl et al. | |
| 8,162,742 | B2 | 4/2012 | Oberberger | |
| 8,172,667 | B2 | 5/2012 | Chim | |
| 8,177,621 | B2 | 5/2012 | Jaffe et al. | |
| 8,231,453 | B2 | 7/2012 | Wolf et al. | |
| 8,251,799 | B2 | 8/2012 | Rommerdahl et al. | |
| 8,308,556 | B2 | 11/2012 | Thomas | |
| 8,328,631 | B2 | 12/2012 | Baerlocher | |
| 8,337,300 | B2 | 12/2012 | Bowers et al. | |
| 8,475,262 | B2 | 7/2013 | Wolf et al. | |
| 8,475,263 | B2 | 7/2013 | Rommerdahl et al. | |
| 8,506,391 | B2 | 8/2013 | Jaffe et al. | |
| 8,585,489 | B2 | 11/2013 | Cannon | |
| 8,715,085 | B2 | 5/2014 | Crowder, Jr. et al. | |
| 8,734,232 | B2 | 5/2014 | Bunch et al. | |
| 8,764,552 | B2 | 7/2014 | Wolf et al. | |
| 8,784,186 | B2 | 7/2014 | Rommerdahl et al. | |
| 8,814,659 | B2 | 8/2014 | Parham et al. | |
| 8,814,666 | B2 | 8/2014 | Luciano, Jr. et al. | |
| 8,827,787 | B2 | 9/2014 | Smith et al. | |
| 8,864,572 | B2 | 10/2014 | Oberberger | |
| 9,005,014 | B2 | 4/2015 | Baerlocher | |
| 9,269,213 | B2 | 2/2016 | Decasa et al. | |
| 2002/0086725 | A1* | 7/2002 | Fasbender | G07F 17/3267 463/11 |
| 2003/0027619 | A1 | 2/2003 | Nicastro, Sr. | |
| 2003/0036429 | A1 | 2/2003 | Witty et al. | |
| 2003/0125107 | A1 | 7/2003 | Cannon | |
| 2003/0228899 | A1 | 12/2003 | Evans | |
| 2004/0048644 | A1 | 3/2004 | Gerrard et al. | |
| 2005/0059446 | A1 | 3/2005 | Kaminkow | |
| 2006/0205468 | A1 | 9/2006 | Saffari et al. | |
| 2006/0205474 | A1 | 9/2006 | Bansemer et al. | |
| 2006/0258434 | A1 | 11/2006 | Jaffe et al. | |
| 2007/0129133 | A1 | 6/2007 | Bansemer et al. | |
| 2007/0218972 | A1* | 9/2007 | Gerson | G07F 17/3258 463/20 |
| 2008/0108410 | A1 | 5/2008 | Baerlocher | |
| 2008/0113697 | A1 | 5/2008 | Rommerdahl et al. | |
| 2008/0311980 | A1 | 12/2008 | Cannon | |
| 2009/0061991 | A1 | 3/2009 | Popovich et al. | |
| 2009/0280891 | A1* | 11/2009 | Filipour | G07F 17/32 463/22 |
| 2009/0318219 | A1* | 12/2009 | Koustas | G07F 17/32 463/23 |
| 2010/0227658 | A1 | 9/2010 | Crowder, Jr. et al. | |
| 2011/0053135 | A1 | 3/2011 | Cramer et al. | |
| 2011/0053676 | A1 | 3/2011 | Wolf et al. | |
| 2011/0111843 | A1* | 5/2011 | Nicely | G07F 17/32 463/27 |
| 2011/0118011 | A1* | 5/2011 | Filipour | G07F 17/32 463/27 |
| 2011/0212766 | A1 | 9/2011 | Bowers et al. | |
| 2011/0212768 | A1 | 9/2011 | Baerlocher | |
| 2011/0218035 | A1 | 9/2011 | Thomas | |
| 2012/0009992 | A1 | 1/2012 | Cannon | |
| 2012/0015713 | A1 | 1/2012 | Cannon | |
| 2012/0083329 | A1 | 4/2012 | Rommerdahl et al. | |
| 2012/0115581 | A1* | 5/2012 | Englman | G07F 17/34 463/25 |
| 2012/0122553 | A1 | 5/2012 | Bunch et al. | |
| 2012/0264495 | A1 | 10/2012 | Amaitis et al. | |
| 2012/0276966 | A1 | 11/2012 | Wolf et al. | |
| 2012/0322531 | A1 | 12/2012 | Rommerdahl et al. | |
| 2013/0065677 | A1 | 3/2013 | Baerlocher | |
| 2013/0273990 | A1 | 10/2013 | Oberberger | |
| 2013/0296020 | A1 | 11/2013 | Wolf et al. | |
| 2014/0087808 | A1 | 3/2014 | Basallo et al. | |
| 2014/0087844 | A1 | 3/2014 | Gilliland et al. | |
| 2014/0228086 | A1 | 8/2014 | Smith et al. | |
| 2014/0235309 | A1 | 8/2014 | Luciano, Jr. et al. | |
| 2014/0235328 | A1 | 8/2014 | Crowder et al. | |
| 2014/0287820 | A1 | 9/2014 | Bunch et al. | |
| 2014/0302898 | A1 | 10/2014 | Vann | |
| 2015/0018072 | A1 | 1/2015 | Palchetti et al. | |
| 2015/0161849 | A1 | 6/2015 | Cannon | |
| 2015/0287264 | A1 | 10/2015 | De Viveiros Ortiz | |
| 2016/0284164 | A1 | 9/2016 | Adams | |
| 2017/0084129 | A1 | 3/2017 | Baerlocher et al. | |

OTHER PUBLICATIONS

U.S. Appl. No. 15/233,114 Preinterview First Office Action, dated Oct. 31, 2017, 2 pages.

U.S. Appl. No. 15/233,114 First Action Interview Office Action, dated Jan. 12, 2018, 3 pages.

U.S. Appl. No. 15/233,114 Final Office Action, dated May 9, 2018, 9 pages.

* cited by examiner

140

190A

| | | | | | | | | | | |
|---|---|---|---|---|---|---|---|---|---|---|
| 15 | 15 | 15 | 15 | 15 | 15 | 15 | 15 | 15 | 15 | 15 |
| 10 | 10 | 10 | 10 | 10 | 10 | 10 | 10 | 10 | 10 | 10 |
| 10 | 10 | 10 | 10 | 10 | 10 | 10 | 10 | 10 | 10 | 10 |
| 5 | 5 | 5 | 5 | 5 | 5 | 5 | 5 | 5 | 5 | 5 |
| 5 | 5 | 5 | 5 | 5 | 5 | 5 | 5 | 5 | 5 | 5 |

FIG. 9A

190B

| | | | | | | | | | | |
|---|---|---|---|---|---|---|---|---|---|---|
| 15 | 25 | 15 | 20 | 15 | 15 | 15 | 60 | 15 | 15 | 15 |
| 10 | 15 | 10 | 35 | 15 | 10 | 10 | 10 | 10 | 10 | 10 |
| 10 | 25 | 10 | 15 | 10 | 10 | 10 | 10 | 15 | 10 | 10 |
| 5 | 10 | 5 | 5 | 10 | 5 | 5 | 5 | 5 | 10 | 5 |
| 5 | 5 | 10 | 5 | 5 | 5 | 5 | 5 | 5 | 10 | 5 |

FIG. 9B

GAMING SYSTEM WITH SKILL-BASED PROGRESSIVE JACKPOT FEATURE

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to a gaming system, machine, and method with a skill-based progressive jackpot feature.

BACKGROUND OF THE INVENTION

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation. As the industry matures, the creativity and ingenuity required to improve such operation of gaming apparatus and games grows accordingly.

SUMMARY OF THE INVENTION

According to one aspect of the present invention, a gaming system comprises a regulated gaming machine primarily dedicated to playing at least one casino wagering game. The gaming machine includes an electronic display device and one or more electronic input devices and game-logic circuitry. The game-logic circuitry is configured to detect, via at least one of the one or more electronic input devices, a physical item associated with a monetary value that establishes a credit balance and initiate the casino wagering game in response to an input indicative of a wager covered by the credit balance. The game-logic circuitry is further configured to increment a progressive jackpot associated with the casino wagering game. In response to a triggering event occurring during the wagering game, the game-logic circuitry is further configured to conduct a skill-based bonus game that awards portions of the incremented progressive jackpot based on skillful inputs of a player. The game-logic circuitry is further configured to receive, via at least one of the one or more electronic input devices, a cashout input that initiates a payout from the credit balance.

According to another aspect of the invention, a computer-implemented method of operating a gaming system, the gaming system including game-logic circuitry and a regulated gaming machine, the gaming machine primarily dedicated to playing at least one casino wagering game, the gaming machine including an electronic display device and one or more electronic input devices, comprises detecting, via at least one of the one or more electronic input devices, a physical item associated with a monetary value that establishes a credit balance. The method further comprises initiating the casino wagering game in response to an input indicative of a wager covered by the credit balance. The method further comprises incrementing a progressive jackpot associated with the casino wagering game. The method further comprises, in response to a triggering event occurring during the casino wagering game, conducting a skill-based bonus game that awards portions of the incremented progressive jackpot based on skillful inputs of a player. The method further comprises receiving, via at least one of the one or more electronic input devices, a cashout input that initiates a payout from the credit balance.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIGS. 9A-9B are representations of a credit distribution table for the bonus game when played in a luck-based or skill-based mode.

Figure 1:
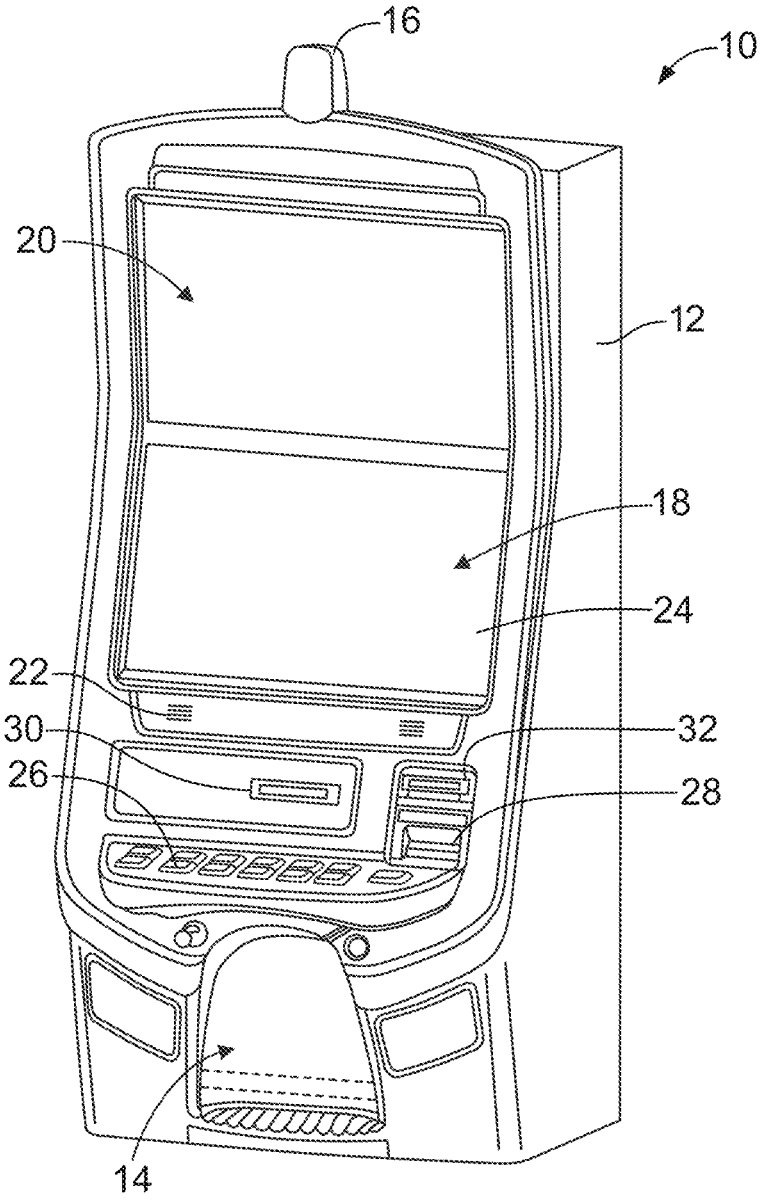
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 3). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
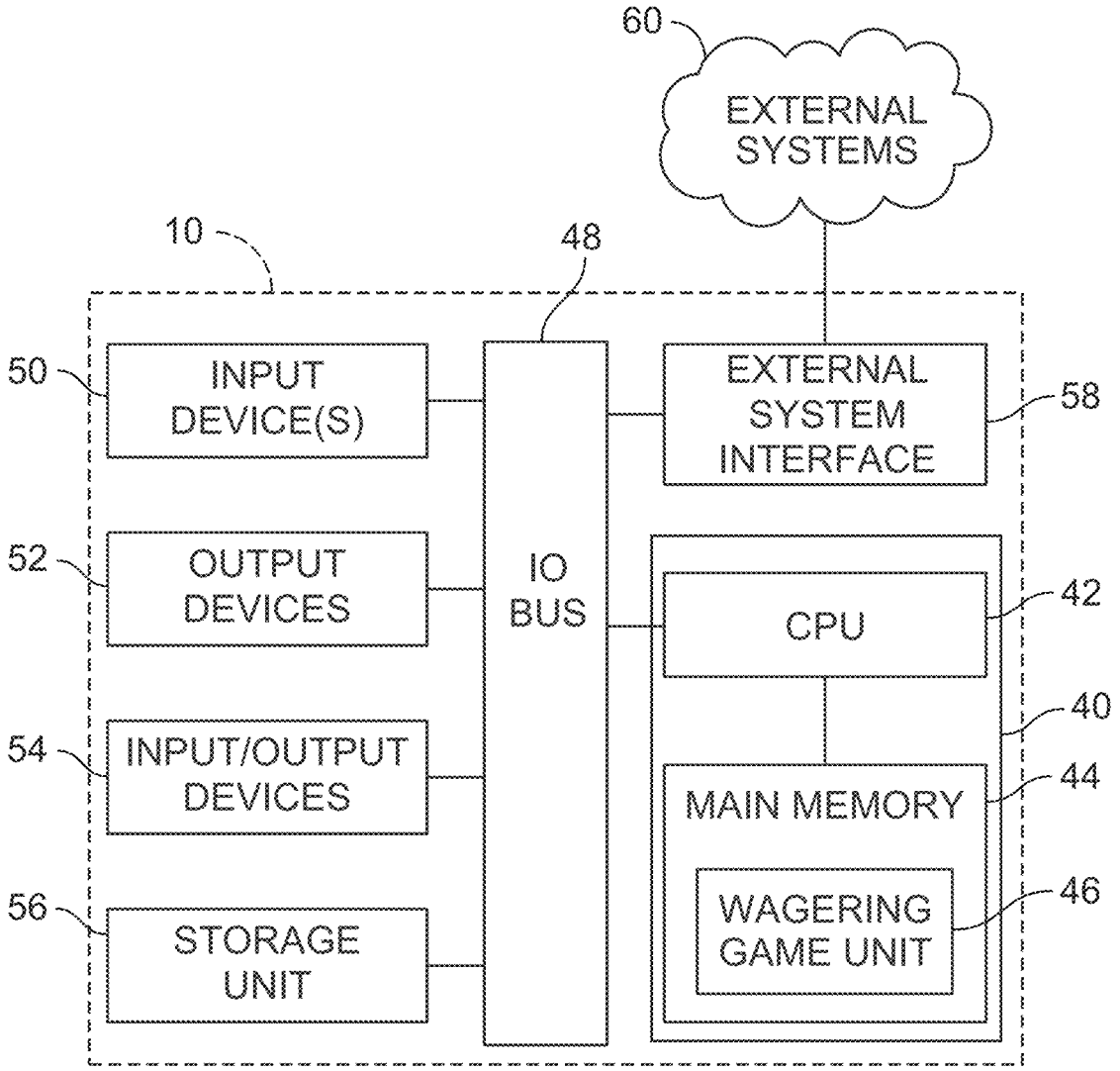
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the random number generator (RNG) programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the random number generator (RNG) is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
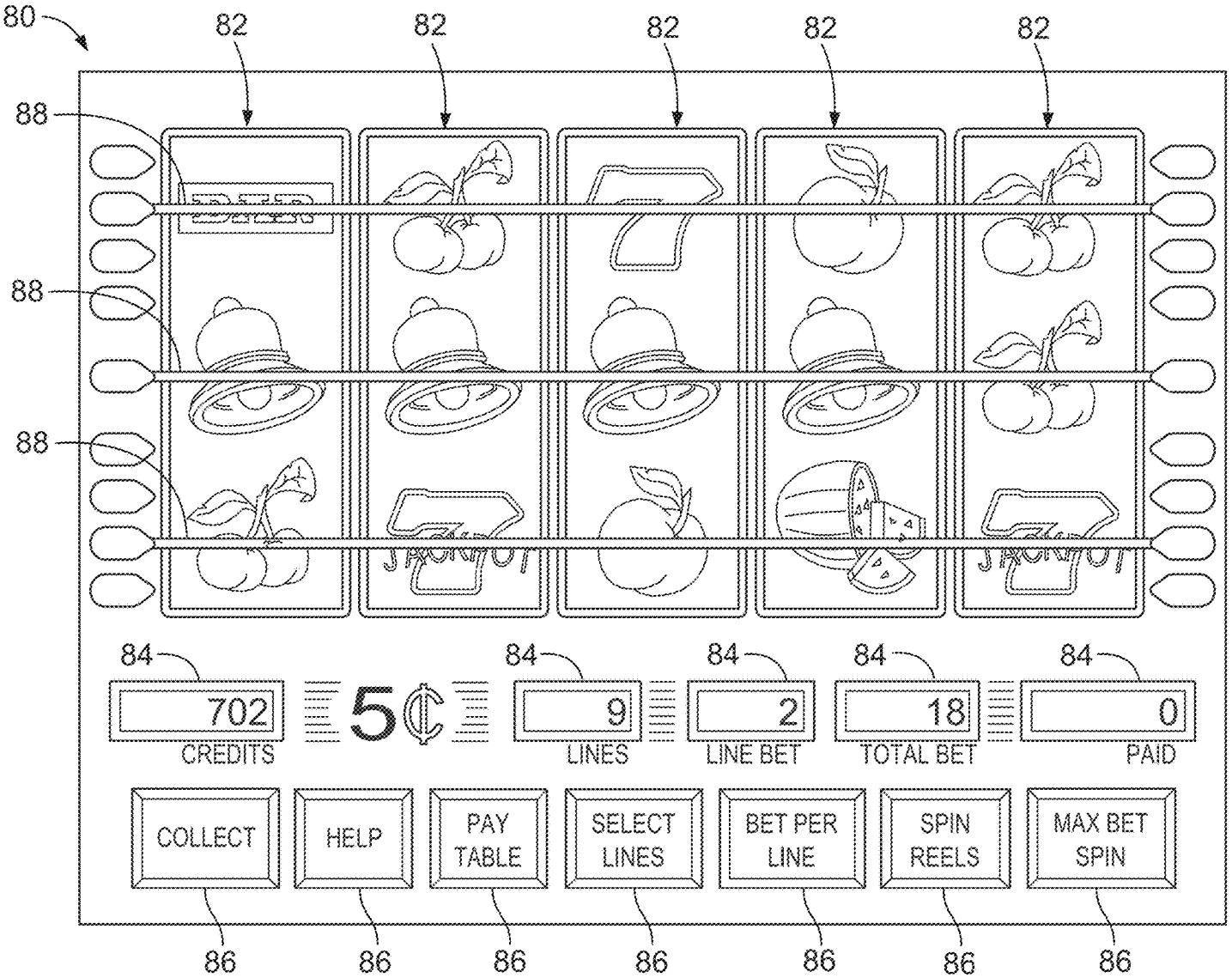
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the random number generator (RNG)) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4:
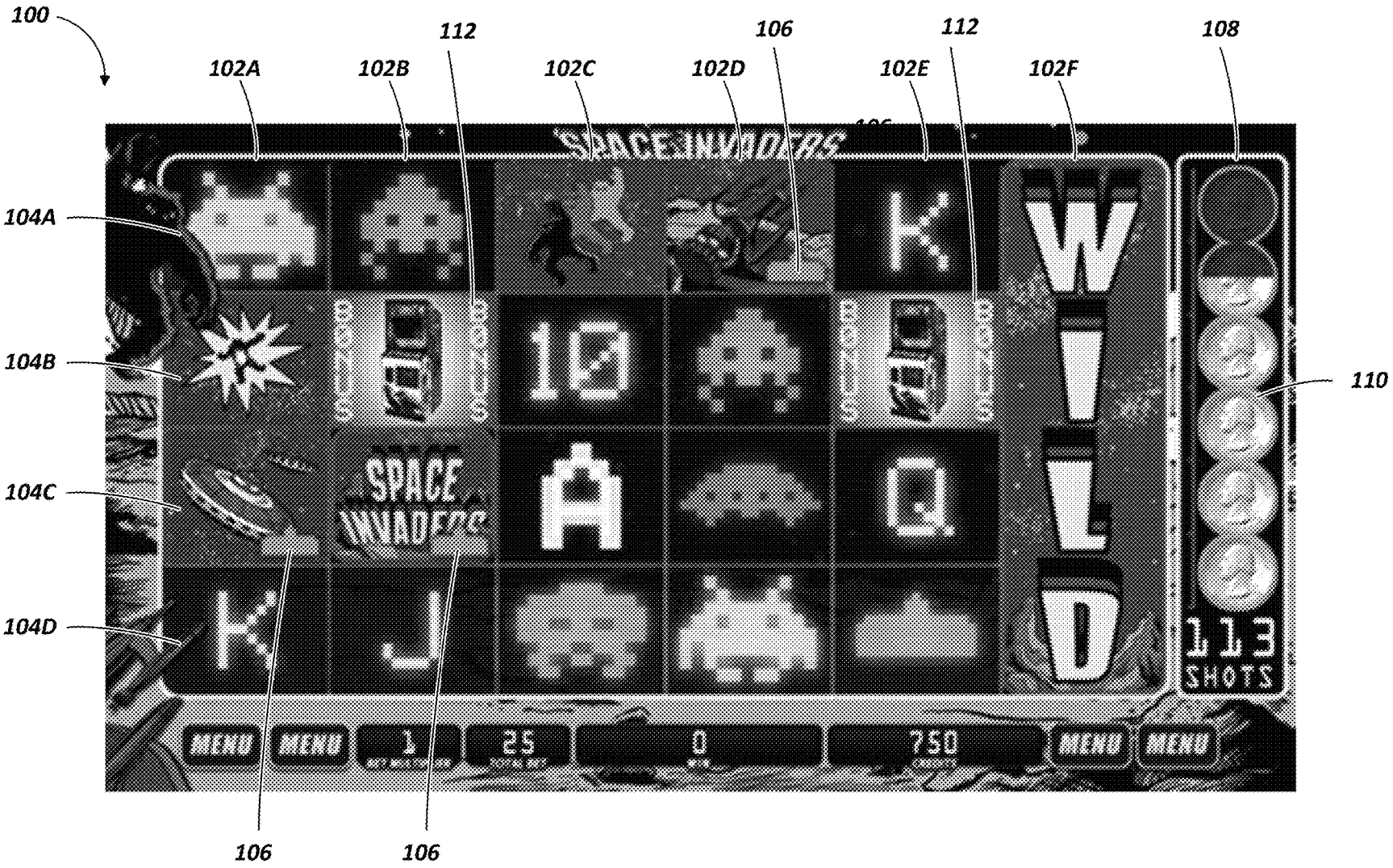
FIG. 4 is an image of a base game screen of a wagering game, the play of which increments a progressive jackpot, according to an embodiment of the present invention.

Referring to FIG. 4, an instance of a base game screen 100 according to an embodiment of the invention is shown. The base game screen 100 is typically displayed on the primary display 18, though may alternatively be displayed on the secondary display 20. In addition to or instead of the features described below, the base game screen optionally includes one or more of the features described in reference to and illustrated in FIG. 3 (e.g., credit meters 84, touch screen buttons 86, paylines 88, etc.). In the present embodiment, the base game screen comprises an array of six reels—a first reel 102A, a second reel 102B, a third reel 102C, a fourth reel 102D, a fifth reel 102E, and a sixth reel 102F. Each reel includes four reel positions—a first reel position 104A, a second reel position 104B, a third reel position 104C, and a fourth reel position 104D. Each of the reels 102, similar to the reels 82 of FIG. 3, are shown to rotate and stop to place symbols in visual association with active paylines of the array to define winning outcomes.

An adjunct symbol may appear on some symbols in the array. In the present embodiment, adjunct symbols appear as "Cannon" symbols 106 displayed in the bottom right corner of a reel position, as shown on the third reel position of the first and second reels and the first reel position of the fourth reel. Adjunct symbols (not to be confused with normal "Cannon" symbols, one of which appears on the fourth reel position of the fifth reel) are added to the array using a plurality of overlay reels on which the adjunct symbols are carried. The overlay reels, which are transparent, spin and stop in synchrony with the reels they overlay, such that the adjunct symbols appear to move at the same speed as other symbols in the array. The overlay reels differ in length to the reels they overlay (length being based on the total number of symbols each reel comprises), ensuring that each adjunct symbol does not remain in a fixed relationship with any particular symbol it overlays. As an alternative to overlay reels, the random number generator (RNG) may be used to randomly select symbols or reel positions from the array on which the adjunct symbols are added.

The appearance of an adjunct symbol during play of the base game may award an opportunity that is used in a bonus game to win a portion of a jackpot prize, which is conducted after a triggering event occurs, as will be described in more detail later. In this case, opportunities are earned through wagered play of the base game and expended through free play of the bonus game. In the present embodiment, opportunities are awarded as "shots" that are accumulated on a "shot" meter 108 appearing to the right of the array. The shot meter 108 is visually represented by a stack of US currency coins or "quarters" 110 which is progressively filled whenever a shot is awarded, with each filled quarter in the stack 110 representing twenty-five accumulated shots. The number of shots awarded for each adjunct symbol that appears during the base game may change according to wager size. For example, each adjunct symbol that appears may award twice as many shots when the wager size of the base game is doubled. Alternatively, the frequency that shots are awarded may be changed according to wager size by adding or removing adjunct symbols from the overlay reels, while still providing the same number of awarded shots for each adjunct symbol that appears. For example, twice as many adjunct symbols may be applied to the overlay reels when the wager size is doubled.

Opportunities or "shots" may also be awarded for other outcomes or events that occur during the base game in addition, or as an alternative, to the appearance of adjunct symbols. For example, a number of shots may be awarded for a particular winning symbol combination appearing in the array, such as when three or more scatter symbols land in the array at the same time. In the present embodiment, a scatter symbol is depicted by the "BONUS" symbol 112 on the second reel position of the second and fifth reels of FIG. 4, with the appearance of three BONUS symbols awarding fifty shots. Additional shots may be awarded for each additional scatter symbol that lands in the scatter combination (eg four or five scatter symbols award one-hundred or one-hundred and fifty shots, respectively). In the present embodiment, reaching a minimum threshold of fifty shots on the shot meter 108 allows the player to selectively trigger the bonus game, while reaching or exceeding a maximum threshold of one-hundred and fifty shots on the shot meter 108 automatically triggers the bonus game, as will be described in more detail later.

The appearance of each adjunct symbol in the array may also increment a progressive jackpot associated with the wagering game by a fixed amount or by an amount that changes according to wager size, as will be explained in more detail later. Alternatively, the progressive jackpot may be incremented each time an input indicative of a wager is received by the gaming machine. Similarly as above, the increment may be a fixed amount or may change depending on wager size.

Figure 5:
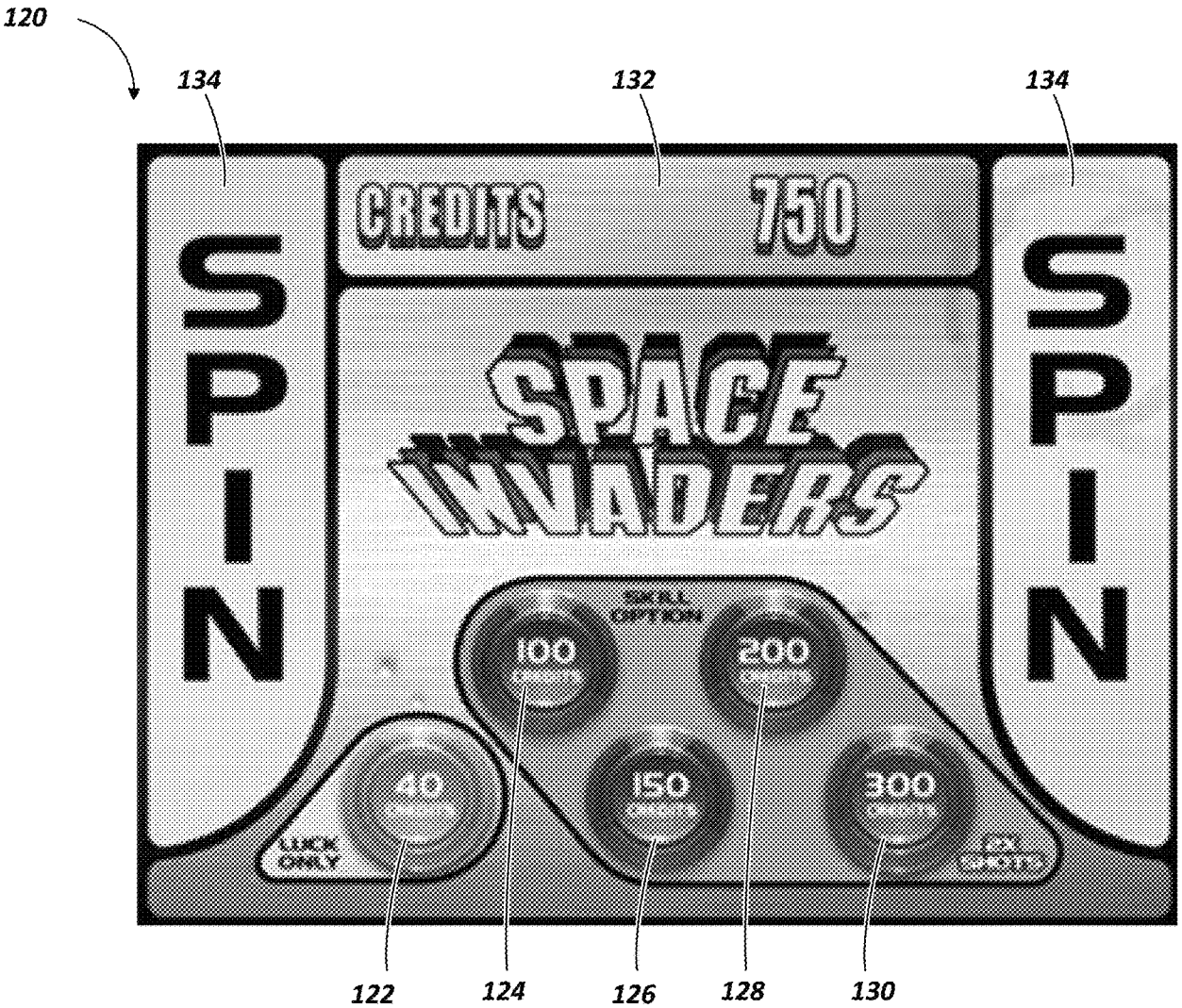
FIG. 5 is an image of a bet interface for providing bet inputs for the base game of FIG. 4.

Referring now to FIG. 5, a bet interface 120 for providing bet inputs for the base game of FIG. 4 is shown. The bet interface 120 may be displayed on a touchscreen provided on the gaming machine in place of physical buttons 26 shown in FIG. 1. The bet interface 120 includes five wager sizes represented by virtual buttons—a 40 credits (minimum) wager size button 122, a 100 credits wager size button 124, a 150 credits wager size button 126, a 200 credits wager size button 128, and a 300 credits (maximum) wager size button 130. The bet interface allows a currently selected wager size to be changed by pressing one of the virtual buttons associated with a different wager size. A credit meter 132 is also displayed in the top portion of the bet interface 120 to indicate the credit amount remaining on the gaming machine. Providing there are sufficient credits available on the gaming machine, the base game can be initiated by either pressing the virtual button associated with the currently selected wager size or the "Spin" area 134 provided on either side of the bet interface 120. In the present embodiment, the number of active paylines associated with the array remains fixed such that same number of active paylines are provided for each wager size. In this case, a bet multiplier is applied to any wins to provide a sense of increased value when playing the base game above the minimum wager size of 40 credits. For example, when playing the game at 100 credits, 150 credits, 200 credits, or 300 credits, a respective bet multiplier of 2×, 3×, 4×, or 5× is applied to any wins that occur during the base game.

As shown in FIG. 5, the different wager size buttons are grouped into one of two different wager groups—a "Luck Only" wager group 134 and a "Skill Option" wager group 136. The "Luck Only" wager group 134, of which only the minimum wager size button 122 belongs, is used to indicate that the bonus game can only be played as a luck-based game while playing the base game at the minimum wager size. The "Skill Option" wager group, on the other hand, indicates that the bonus game can be optionally played as a skill-based game if the bonus game is triggered while the base game is played above the minimum wager size.

In the present embodiment, when the base game is played at the minimum wager size, the appearance of an adjunct symbol in the array does not award any shots or add any increment to the progressive jackpot. In contrast, when the base game is played at the maximum wager size, the appearance of an adjunct symbol in the array awards twice as many shots (as indicated by "2× Shots" appearing next to wager size button 130) and adds twice the increment value to the progressive jackpot than is otherwise provided for other wager sizes above minimum.

Figure 6:
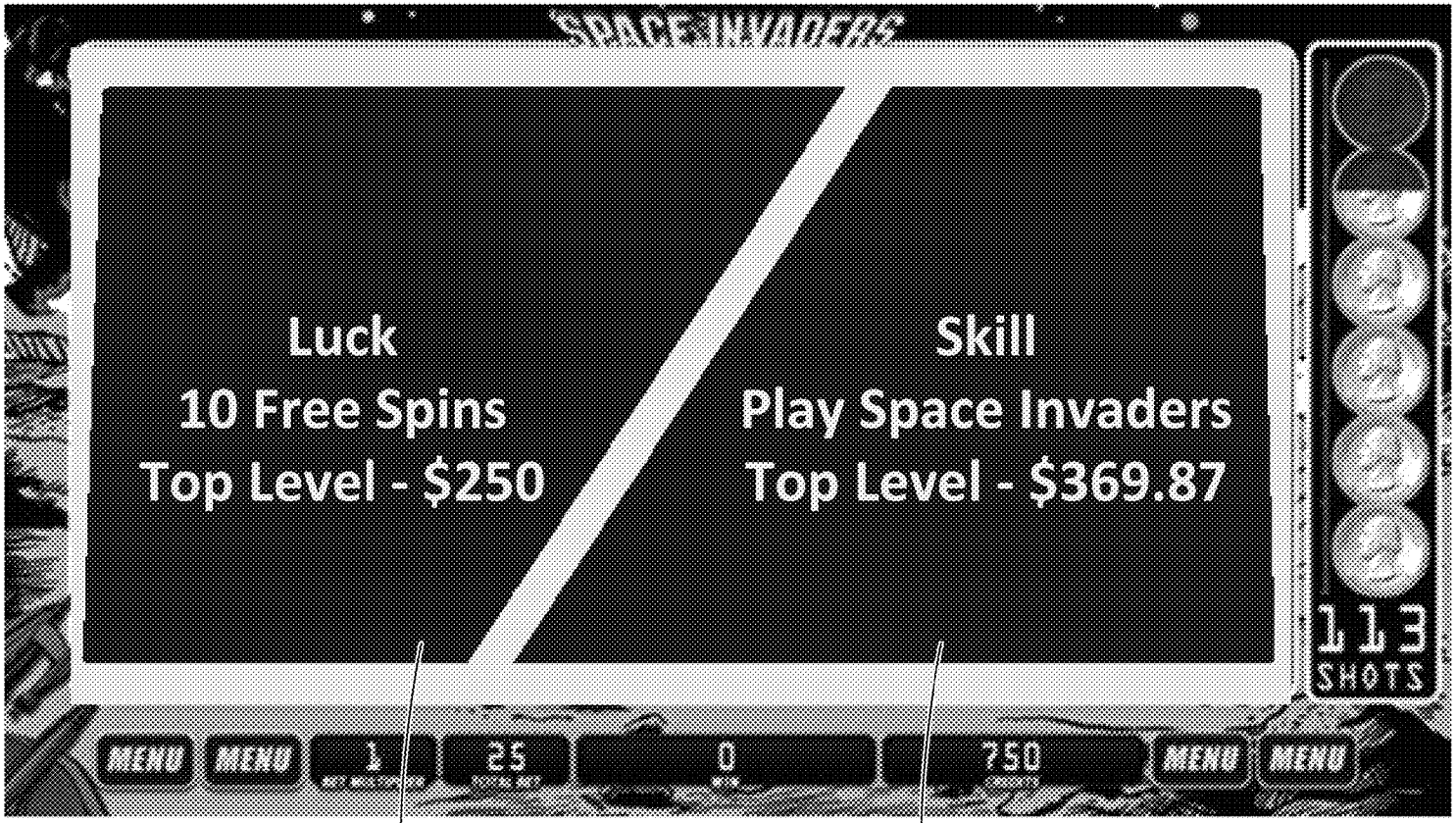
FIG. 6 is an image of a bonus game mode interface to selectively play a bonus game in either a skill-based or luck-based mode.

Referring now to FIG. 6, an image of a mode interface 140 for the bonus game is shown. The mode interface 140 may be either selectively or automatically displayed over the base game screen depending on the number of shots accumulated on the shot meter 108. In the present embodiment, the mode interface 140 is selectively displayed by pressing a "Play Bonus" button (not shown) that appears below the shot meter 108 after a minimum threshold of fifty shots is reached. In contrast, the mode interface 140 is automatically displayed after the maximum threshold of one-hundred and fifty shots has been reached or exceeded, providing the maximum threshold was reached or exceeded while playing above the minimum wager size.

If the mode interface 140 is selectively displayed while the base game is played above the minimum wager size, the player may optionally play the bonus game in either a luck-based mode or a skill-based mode by pressing a respective "Luck" area 142 or "Skill" area 144 on the mode interface 140 to trigger the bonus game. If, however, the mode interface 140 is selectively displayed while the base game is played at the minimum wager size, the player will only be able to play the bonus game in the luck-based mode, such that the "Skill" area 144 is not shown on the mode interface 140 or remains inactive when pressed to indicate the skill-based mode is not currently available. In either case, the player may return to the base game by pressing a "Return" button (not shown) such that commencing play of (ie selectively triggering) the bonus game remains optional so long as the number of shots accumulated on the shot meter 108 remains under the maximum threshold. If the mode interface 140 is automatically displayed, the player must start (ie trigger) the bonus game by pressing either the "Luck" area 142 or the "Skill" area 144 on the mode interface 140, in which case the "Return" button (not shown) is not displayed. If the player reaches or exceeds the maximum threshold of shots while playing the base game at the minimum wager size, the bonus game will be automatically triggered in the luck-based mode, such that the mode interface 140 will not be displayed.

By selecting to play the bonus game in the luck-based mode, the player is only eligible to win a reset (also known as "seed") value associated with the jackpot which, as indicated in the "Luck" area 142, has a "Top Level" value of $250. Alternatively, by selecting to play the bonus game in the skill-based mode, the player is eligible to win the reset value of the jackpot and any increments added to it (ie the progressive value) which, as indicated in the "Skill" area 144, has a "Top Level" value of $369.87.

Figure 7:
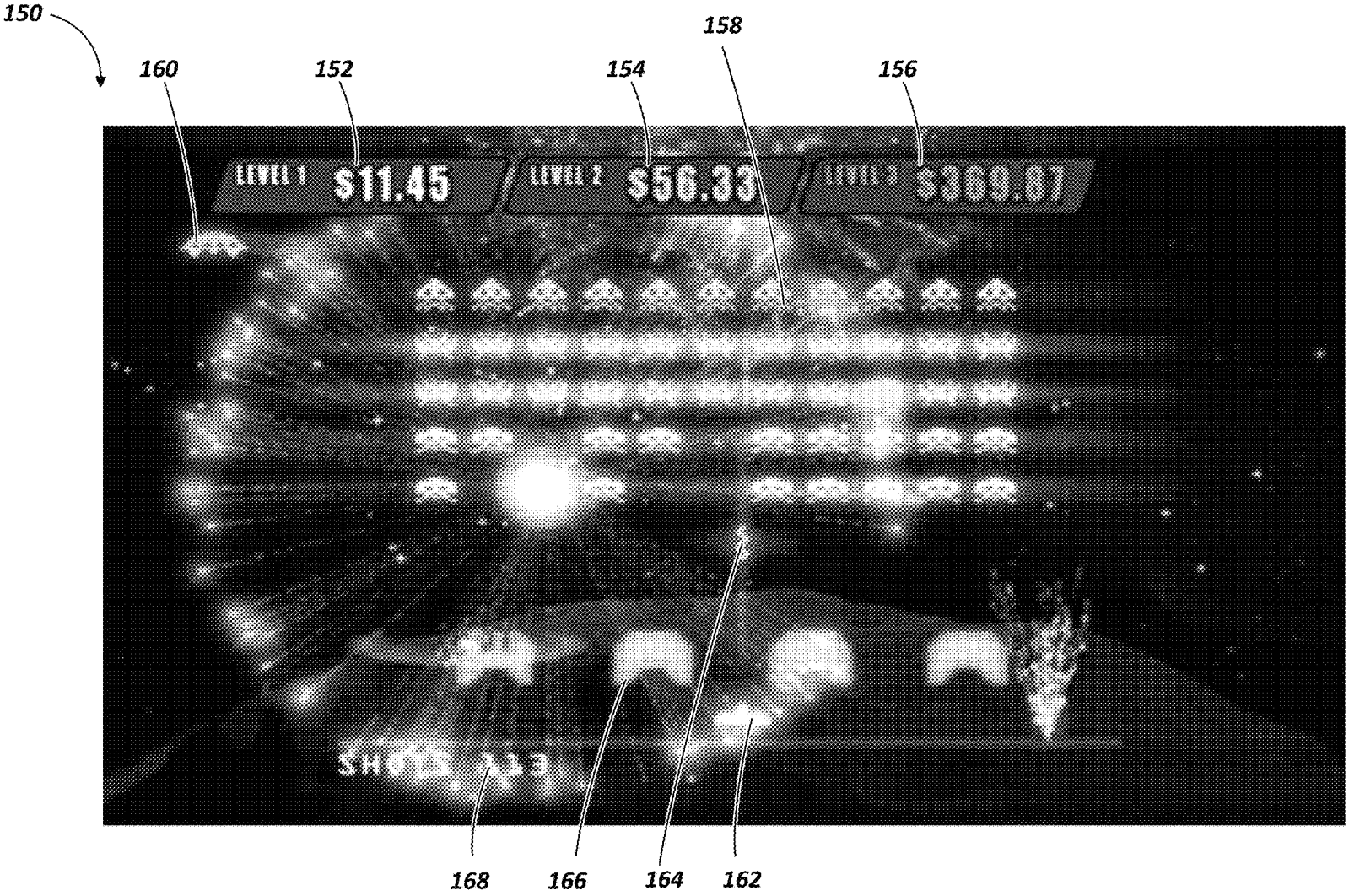
FIG. 7 is an image of a bonus game screen when the skilled-based mode is selected.

Referring now to FIG. 7, an instance of a bonus game screen 150 according to an embodiment of the invention is shown. The bonus game screen 150 is typically displayed on the secondary display 20, though may alternatively be displayed on the primary display 18. In the present embodiment, the bonus game is based on the classic arcade shooter "Space Invaders". The progressive jackpot is divided into three different levels—Level 1 (bottom), Level 2 (middle), and Level 3 (top), with each jackpot level being associated with a respective level of the bonus game. As previously indicated in FIG. 6, the top level jackpot has a reset value of $250, while the middle and bottom level jackpots have a respective reset value of $50 and $10. In the present embodiment, the bonus game is shown in the skill-based mode, as indicated by the Level 1 (bottom) jackpot meter 152, Level 2 (middle) jackpot meter 154, and Level 3 (top) jackpot meter 156 having current respective progressive values of $11.45, $56.33, and $369.87.

Game play during the skill-based bonus game is substantially similar to the original arcade version of "Space Invaders". In this case, a plurality of discrete elements, represented by a wave of alien sprites 158, move horizontally back and forth while advancing towards the bottom of the display. A UFO sprite 160 may also fly across the top of the display at random or scripted intervals of gameplay that provides a mystery prize if shot, which will be discussed in more detail later. The player controls a cannon 162 positioned at the bottom of the display that can move horizontally across the bottom of the display and fire shots 164 at the wave of alien sprites 158. The object of the game is to destroy the wave of alien sprites 158 by hitting them with shots fired from the cannon 162 before any reach the bottom of the display, while at the same time avoid being hit by shots fired from the alien sprites 158. To aid the player, the cannon 162 is partially protected by four stationary bunkers which are gradually destroyed by shots fired from either the cannon 162 or wave of alien sprites 158. As more alien sprites 158 are destroyed, the movement of the remaining alien sprites 158 speeds up, thus increasing the difficulty of the game. After destroying the wave of alien sprites 158, the game advances to the next level, in which case the wave of alien sprites move at a faster rate.

However, unlike in the original arcade version of "Space Invaders", the player is awarded a credit value associated with each alien sprite 158 that is destroyed. Furthermore, the number of shots the player can expend or fire in the bonus game is limited to the number of shots accumulated in the base game before the bonus game was triggered, as shown on shot meter 168. Finally, if the bonus game ends (ie the player runs out of lives by the cannon 162 getting hit by a shot or the wave of alien sprites 158 reaching the bottom of the display) before all the accumulated shots have been used, the player is provided with a consolation prize having a value proportional to the number of shots left on the meter, in which case the player will return to the base game with the shot meter reset to zero. In the event the bonus game is triggered by exceeding the maximum threshold of shots, the player will return to the base game and any accumulated shots over the maximum threshold of one-hundred and fifty will be added to the shot meter 108.

Figure 8:
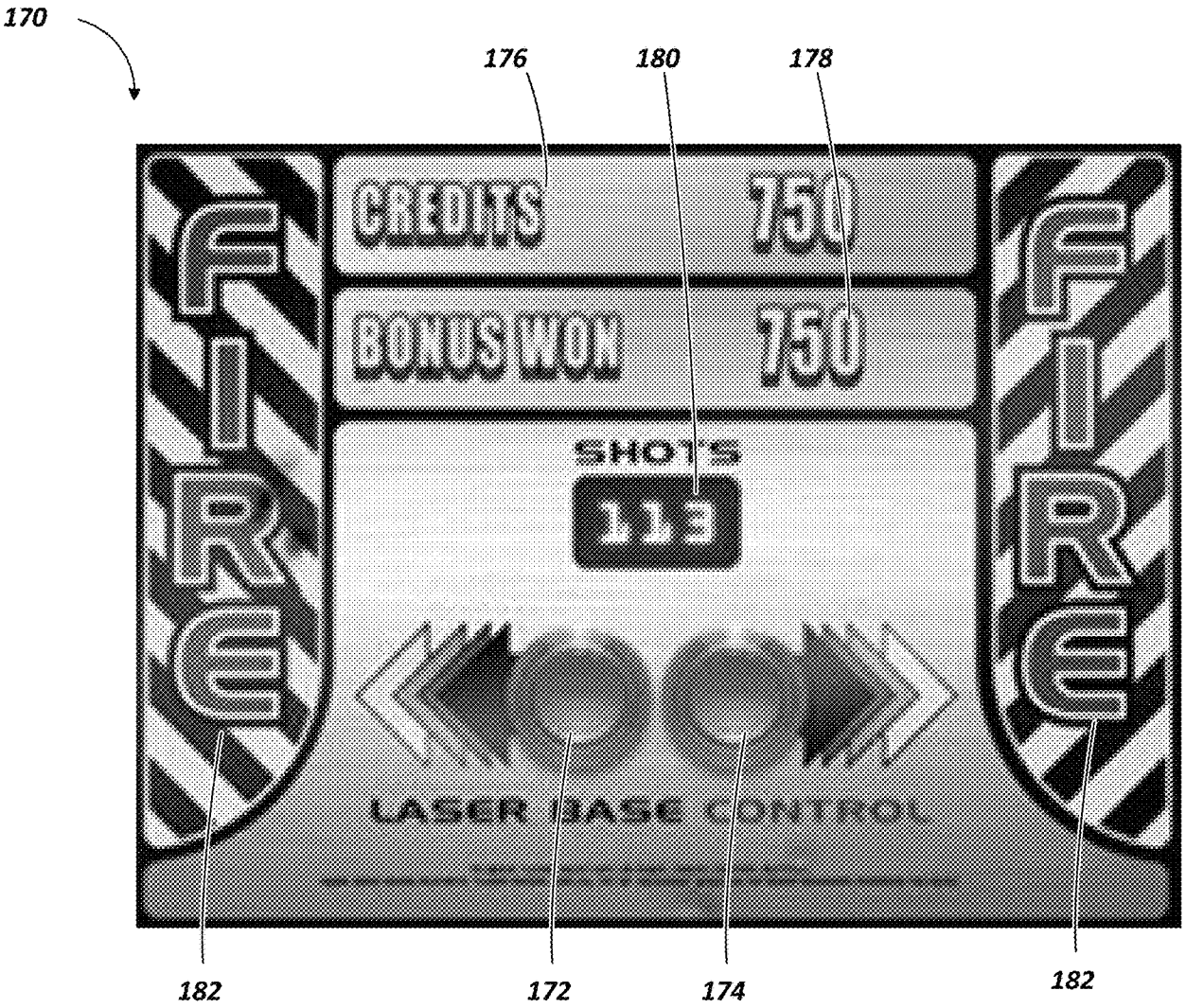
FIG. 8 is an image of a control interface for providing skillful inputs for the bonus game of FIG. 7.

Referring to FIG. 8, a control interface 170 for providing skillful inputs for the skill-based bonus game is shown. The control interface 170 is displayed on a touchscreen in place of physical buttons, as previously discussed in relation to FIG. 5. The control interface 170 includes direction control buttons 172, 174 to move the cannon left or right across the bottom of the display. A credit meter 176 and win meter 178 is also displayed in the top portion of the control interface to indicate the number of credits remaining and the number of credits won by the player while playing the bonus game. A shot meter 180 is also provided in the control interface 170 to indicate the number of shots remaining, which are expended by pressing the "Fire" area 182 located on either side of the control interface 170.

Referring to FIGS. 9A-B, a credit distribution table 190A-B for the bonus game is shown. The credit distribution table 190A-B is divided into five rows of eleven columns each to form fifty-five cells. Each cell of the table is provided with a credit value that is associated with an alien sprite 158 that occupies a similar position in the wave of alien sprites depicted in the bonus game shown in FIG. 7.

FIG. 9A depicts how a portion of the reset or "seed" value of the bottom jackpot level is distributed among the wave of alien sprites associated with Level 1 of the bonus game. Alien sprites 158 that appear in the lowest and second lowest row of the wave have an reset value of 5 credits each, alien sprites 158 appearing in the middle row and second highest row of the wave have a reset value of 10 credits each, while alien sprites 158 appearing in the highest row of the wave have a reset value of 15 credits each. In this case, the portion of the Level 1 (bottom) jackpot that is assigned to the wave of alien sprites is 22×5 credits+22×10 credits+11×15 credits=660 credits or $6.60 (one credit being equal to one cent). Accordingly, a portion of the progressive jackpot while the remaining portion of the reset value associated with the bottom jackpot (in this case, $3.40) is won once the associated wave of alien sprites is destroyed.

FIG. 9B shows how increments are added to the wave of alien sprites 158 associated with Level 1 of the bonus game. In the present embodiment, each adjunct symbol that appears when the base game is played above the minimum wager size adds an increment value of 5 credits (or twice this when playing at maximum wager size) to the jackpot. As such, twelve increments have been assigned to three alien sprites in the highest row, seven increments have been assigned to three alien sprites in the second highest row, five increments have been assigned to three alien sprites in the middle row, three increments have been assigned to three alien sprites in the second lowest row, and two increments have been assigned to two alien sprites in the lowest row. In this case, the total increment value added to the lowest jackpot prize is 29 (ie 12+7+5+3+2)×5 credits=145 credits, or $1.45, thus increasing the value assigned to the wave of alien sprites to $8.05. Since the remaining portion of the reset value associated with the bottom jackpot remains unchanged, the total progressive value of the bottom jackpot is $11.45.

The allocation of increments within the wave of alien sprites 158 determines the level of difficulty in winning each increment. For example, alien sprites which are located in higher rows of the wave are more difficult to shoot without first hitting alien sprites located in lower rows of the wave. Accordingly, weighting the distribution of increments so that higher rows of alien sprites in the wave contain more value than the lower rows of alien sprites increases the difficulty in winning a majority of the increment value that is added to the jackpot prize. In addition, since increments are distributed amongst three separate jackpot levels, weighting the distribution of increments such that the majority of the increment value is distributed to the higher jackpot levels further increases the difficulty in winning a majority of the increment value during play of the bonus game.

If playing the bonus game in luck-based mode, a round of ten free spins is provided, as indicated in FIG. 6. In the present embodiment, the round of ten free spins is shown in the primary display 18 so as to appear similar to the base game. A wave of alien sprites 158 is also shown in the secondary display 20, so as to appear similar to the skill-based bonus game. However, the cannon 162 is automatically controlled to move and fire at the wave of alien sprites 158 each time an adjunct symbol 106 appears in the array of the primary display 18 during the round. In this case, the array shown in the primary display 18 is used to provide a random event for firing shots that player has accumulated, and does not provide awards for winning symbol combinations that may appear during the round. In a similar manner to the skill-based bonus game, the player is awarded credits for each alien sprite that is destroyed in the luck-based bonus game. However, the player only receives the reset value, but not the incremented value, associated with each alien sprite destroyed, as shown in the credit distribution table of FIG. 9A.

Shooting the UFO sprite 160 awards one of a number of randomly selected outcomes—"Level Advance", "Level Clear", or "Level Jackpot". When the "Level Advance" outcome is randomly selected, the player is advanced to the next level of the bonus game, but does not receive any credit awards associated with the remaining alien sprites. When the 'Level Clear' outcome is selected, each of the credit values assigned to alien spites 158 remaining in the current wave is awarded and the player advances to the next level of the bonus game, but does not receive the remaining portion of the reset value associated with the current jackpot level. When the 'Level Jackpot' outcome is selected, the player is awarded each of the credit values assigned to the alien sprites remaining in the wave, as well as the remaining portion of the reset value associated with the current jackpot level and the player is advanced to the next level of the bonus game.

It should be noted that while the present embodiment of the base wagering game and skill-based bonus game is represented by a slot game and an arcade shooter game, respectively, any game or combination of games that allows the player to accrue opportunities for the player's skill to return a portion of a jackpot value may be employed. For example, the bonus game may also take the form of an arcade racing game, in which opportunities are expended as track time (or fuel) that runs down as the player races around a course, the player winning portions of the progressive jackpot by overtaking opponents such that each opponent has a portion of the jackpot value assigned to them. Alternatively, the wagering game may be provided as a card game, wherein an opportunity is awarded each time the player receives a specially marked card. Similarly, the bonus game may also be provided as a card game, in which case opportunities are expended as cards or hands that the player receives during play of one or more rounds. In this case, the player wins portions of a jackpot value by winning hands such that each card or hand has a portion of the jackpot value assigned to it. As such, it is further noted that the term "skill" and "skillful input" should be considered inclusive of both a player's reflexes and/or strategy in playing the bonus game. For example, the bonus game may be further represented by a game of chess, in which case opportunities are expended in the form of moves, the player winning portions of a jackpot value by capturing opposing game pieces, such that each opponent's game piece has a portion of the jackpot value assigned to it.

Figure 10:
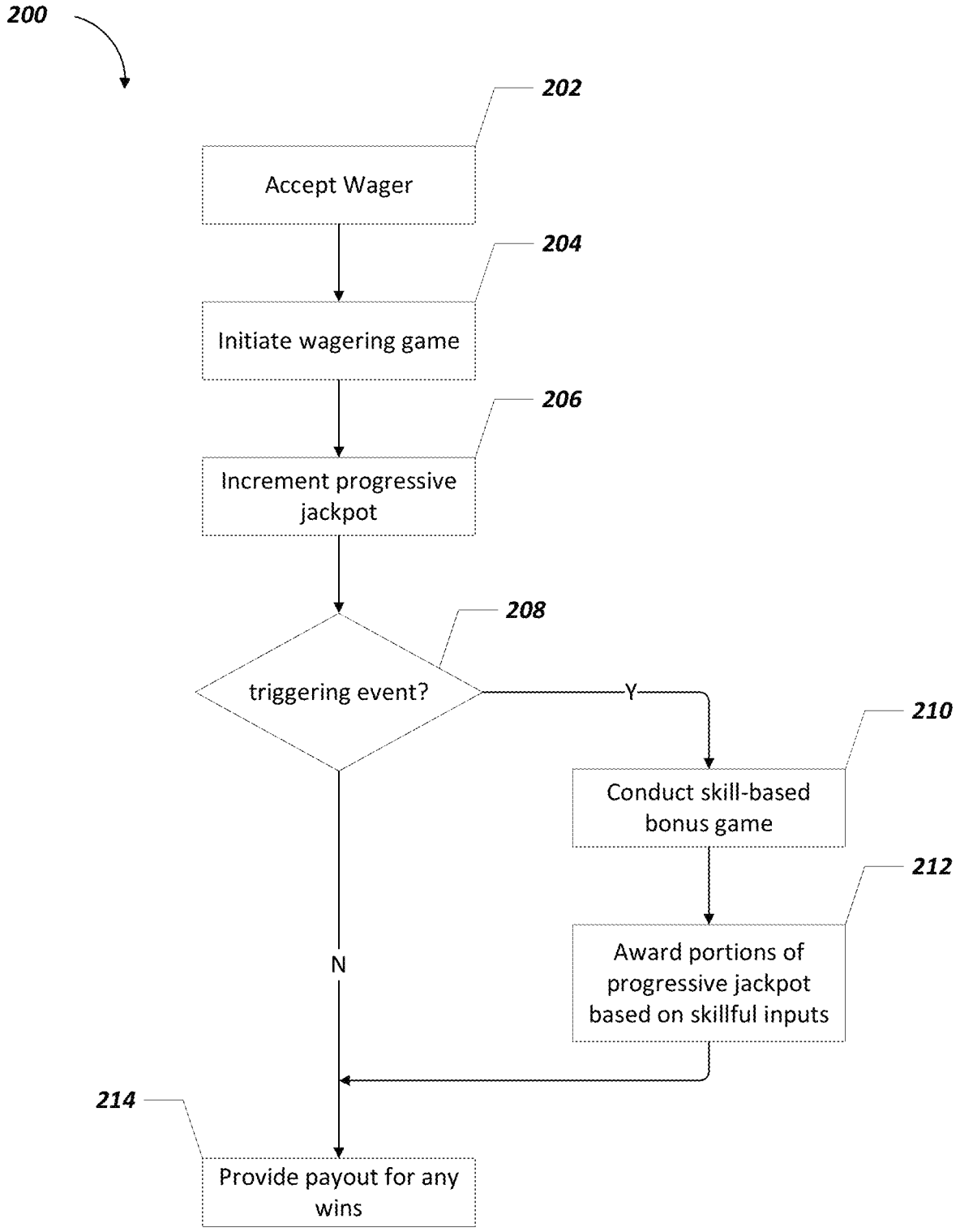
FIG. 10 is a flowchart for a data processing method that corresponds to instructions executed by a controller in accord with at least some aspects of the disclosed concepts.

FIG. 10 shows one example of various operations performed by rule sets in accord with one aspect of the present concepts in which a computer readable media bearing instructions is accessed by one or more processors, which execute the instructions and causes the performance of operations in association with the skill-based progressive jackpot feature described in any of the various aspects described herein. FIG. 10 shows an example wherein such operations include accepting a wager to play a wagering game (step 202). The instructions further cause the processors to initiate play of the wagering game (step 204). The instructions further cause the processors to increment a progressive jackpot (step 206). The instructions further require processors to determine if a triggering event occurred during play of the wagering game (step 208). In the event that a triggering event has occurred, the instructions further require processors to conduct a skill-based bonus game (step 210). The instructions further require processors to award portions of the progressive jackpot based on skillful inputs of a player while playing the skill-based bonus game (step 212). The instructions further provide for the processors to provide a payout for any wins received while playing either the wagering game or bonus game (step 214).

FIG. 10, described by way of example above, represents one algorithm that corresponds to at least some instructions stored and executed by the game-logic circuitry 40 in FIG. 2 to perform the above described functions associated with the disclosed concepts.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system, comprising:

a regulated gaming machine primarily dedicated to playing at least one casino wagering game, the regulated gaming machine including an electronic display device and one or more electronic input devices; and game-logic circuitry configured to:

detect, via at least one of the one or more electronic input devices, a physical item associated with a monetary value that establishes a credit balance;

initiate the casino wagering game in response to an input indicative of a wager covered by the credit balance;

increment a progressive jackpot associated with the wagering game, wherein incrementing the progressive jackpot comprises incrementing at least one of a plurality of awards associated with respective ones of a plurality of discrete elements to be later displayed in a skill-based bonus game, each of the plurality of awards comprising less than a full portion of the incremented progressive jackpot;

in response to a triggering event occurring during the wagering game, conduct a skill-based bonus game that awards portions of the incremented progressive jackpot based on skillful inputs of a player via use of at least one of the one or more electronic input devices, wherein the game-logic circuitry is configured to conduct the skill-based bonus game using a processor that electronically interprets one or more electronic data signals indicative of the skillful inputs of the player, automatically changes a visual representation of one or more of the plurality of discrete elements via the electronic display device in response to the skillful inputs of the player being electronically interpreted, generates a random number value using a seeding process that cycles at a speed of a minimum of one hundred calls per second, and automatically applies each increment of the progressive jackpot to the each of the respective ones of the plurality of discrete elements based on the random number value; and receive, via at least one of the one or more electronic input devices, a cashout input that initiates a payout from the credit balance.

2. The gaming system of claim 1, further including a random element generator configured to generate one or more random elements, an outcome of the wagering game being randomly selected based, at least in part, on the one or more random elements.

3. The gaming system of claim 1, wherein the portion of the incremented progressive jackpot is awarded by expending an opportunity that is earned during play of the wagering game.

4. The gaming system of claim 3, wherein the skill-based bonus game is provided in the form of a shooter-style video game.

5. The gaming system of claim 4, wherein the opportunity is a shot that may be expended during play of the shooter-style video game.

6. The gaming system of claim 1, wherein each increment of the progressive jackpot is randomly applied to one of the discrete elements by a processor that executes a random number generator with a seeding process that relies upon an unpredictable factor and cycles continuously during play of the wagering game.

7. The gaming system of claim 1, wherein the progressive jackpot includes a reset value, and wherein a portion of the reset value is distributed among the discrete elements in a predefined manner.

8. The gaming system of claim 1, wherein the game-logic circuitry is further configured to provide an option for the player to select a luck-based bonus game as an alternative to playing the skill-based bonus game, wherein the luck-based bonus game allows a portion of a reset value, but not the incremented value, of the progressive jackpot to be won.

9. A method of operating a gaming system, the gaming system including game-logic circuitry and a regulated gaming machine, the gaming machine primarily dedicated to playing at least one casino wagering game, the gaming machine including an electronic display device and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

incrementing a progressive jackpot associated with the wagering game, wherein incrementing the progressive jackpot comprises incrementing at least one of a plurality of awards associated with respective ones of a plurality of discrete elements to be later displayed in a skill-based bonus game, each of the plurality of awards comprising less than a full portion of the incremented progressive jackpot;

in response to a triggering event occurring during the wagering game, conducting a skill-based bonus game that awards portions of the incremented progressive jackpot based on skillful inputs of a player via use of at least one of the one or more electronic input devices, wherein said conducting the skill-based bonus game comprises using a processor that electronically interprets one or more electronic data signals indicative of the skillful inputs of the player, generates a random number value using a seeding process that relies upon an unpredictable factor and cycles continuously during play of the wagering game at a speed of a minimum of one hundred calls per second, automatically applies the incrementing of the progressive jackpot to one of the respective ones of the plurality of discrete elements based on the random number value, and automatically changes a visual representation of one or more of the plurality of discrete elements via the electronic display device in response to the skillful inputs of the player being electronically interpreted; and receiving, via at least one of the one or more electronic input devices, a cashout input that initiates a payout from the credit balance.

10. The method of claim 9, further including generating one or more random elements, an outcome of the wagering game being randomly selected based, at least in part, on the one or more random elements.

11. The method of claim 9, wherein the portion of the incremented progressive jackpot is awarded by expending an opportunity that is earned during play of the wagering game.

12. The method of claim 11, wherein the skill-based bonus game is provided in the form of a shooter-style video game.

13. The method of claim 12, wherein the opportunity is a shot that may be expended during play of the shooter-style video game.

14. The method of claim 9, wherein the progressive jackpot includes a reset value, and wherein a portion of the reset value is distributed among the discrete elements in a predefined manner.

15. The method of claim 9, wherein the game-logic circuitry is further configured to provide an option for the player to select a luck-based bonus game as an alternative to playing the skill-based game, wherein the luck-based bonus game allows a portion of a reset value, but not the incremented value, of the progressive jackpot to be won.

* * * * *